US012241692B2

(12) United States Patent
Lochner et al.

(10) Patent No.: US 12,241,692 B2
(45) Date of Patent: Mar. 4, 2025

(54) METHOD FOR OPERATING A HEAT EXCHANGER, ARRANGEMENT WITH A HEAT EXCHANGER, AND SYSTEM WITH A CORRESPONDING ARRANGEMENT

(71) Applicant: Linde GmbH, Pullach (DE)

(72) Inventors: Stefan Lochner, Grafing (DE); Ralph Spöri, Egling (DE); Axel Lehmacher, Egling-Moosham (DE); Pascal Freko, Eurasburg (DE); Paul Heinz, Munich (DE); Felix Rößler, Munich (DE)

(73) Assignee: Linde GmbH, Pullach (DE)

( * ) Notice: Subject to any disclaimer, the term of this patent is extended or adjusted under 35 U.S.C. 154(b) by 441 days.

(21) Appl. No.: 17/596,999

(22) PCT Filed: Aug. 18, 2020

(86) PCT No.: PCT/EP2020/025378
§ 371 (c)(1),
(2) Date: Dec. 22, 2021

(87) PCT Pub. No.: WO2021/037391
PCT Pub. Date: Mar. 4, 2021

(65) Prior Publication Data

US 2022/0316811 A1 Oct. 6, 2022

(30) Foreign Application Priority Data

Aug. 23, 2019 (EP) ..... 19020492

(51) Int. Cl.
*F25J 1/00* (2006.01)
*F25J 1/02* (2006.01)
(Continued)

(52) U.S. Cl.
CPC ..... *F28D 21/00* (2013.01); *F25J 1/0015* (2013.01); *F25J 1/0251* (2013.01); *F25J 1/0261* (2013.01);
(Continued)

(58) Field of Classification Search
CPC ..... F25J 5/002; F25J 3/04824; F25J 3/04787; F25J 2280/20
See application file for complete search history.

(56) References Cited

U.S. PATENT DOCUMENTS

| | | | |
|---|---|---|---|
| 5,233,839 | A | 8/1993 | Greter et al. |
| 2012/0167616 | A1 | 7/2012 | Burger et al. |
| 2015/0226094 | A1 | 8/2015 | Alekseev |

FOREIGN PATENT DOCUMENTS

| | | | |
|---|---|---|---|
| CN | 102778105 | A | 11/2012 |
| DE | 102014018412 | A1 | 6/2016 |

(Continued)

*Primary Examiner* — Eric S Ruppert
(74) *Attorney, Agent, or Firm* — Millen, White, Zelano & Branigan, P.C.; Brion P. Heaney

(57) ABSTRACT

A method for operating a heat exchanger, in which a first operating mode is carried out in first time periods, and a second operating mode is carried out in second time periods that alternate with the first time periods; in the first operating mode a first fluid flow is formed at a first temperature level, is fed into the heat exchanger in a first region at the first temperature level, and is partially or completely cooled in the heat exchanger; in the first operating mode a second fluid flow is formed at a second temperature level, is fed into the heat exchanger in a second region at the second temperature level, and is partially or completely heated in the heat exchanger. A corresponding arrangement and a system with such an arrangement are also covered by the present invention.

21 Claims, 4 Drawing Sheets

(51) Int. Cl.
*F25J 3/04* (2006.01)
*F28D 21/00* (2006.01)

(52) U.S. Cl.
CPC ..... *F25J 3/04187* (2013.01); *F25J 3/04787* (2013.01); *F25J 2215/42* (2013.01); *F25J 2290/32* (2013.01); *F28D 2021/0033* (2013.01)

(56) References Cited

FOREIGN PATENT DOCUMENTS

| | | | |
|---|---|---|---|
| EP | 2 880 267 | A2 | 6/2015 |
| EP | 3 032 203 | A1 | 6/2016 |
| EP | 3339784 | A1 | 6/2018 |
| EP | 2 449 324 | B1 | 11/2018 |
| JP | 4688843 | B2 | 5/2011 |

METHOD FOR OPERATING A HEAT EXCHANGER, ARRANGEMENT WITH A HEAT EXCHANGER, AND SYSTEM WITH A CORRESPONDING ARRANGEMENT

The present invention relates to a method for operating a heat exchanger, to an arrangement having a correspondingly operable heat exchanger, and to a system having a corresponding arrangement according to the preambles of the respective independent claims.

PRIOR ART

In many fields of application, heat exchangers (technically more correct: heat transfer devices) are operated with cryogenic fluids, i.e., fluids at temperatures significantly below 0° C.—in particular, significantly below −50° C. or −100° C. The present invention is described below mainly with reference to the main heat exchangers of air separation systems, but is in principle also suitable for use in other fields of application, e.g., for systems for storing and recovering energy using liquid air, or for natural gas liquefaction or systems in petrochemistry.

For the reasons explained below, the present invention is also particularly suitable in systems for liquefying gaseous air products—for example, gaseous nitrogen. Corresponding systems can, in particular, be supplied with gaseous nitrogen from air separation systems and liquefy it. In this case, liquefaction is not followed by rectification, as in an air separation system. Therefore, when the problems explained below are overcome, these systems can be completely switched off, e.g., when there is no demand for corresponding liquefaction products, and kept in standby until the next use.

For the construction and operation of main heat exchangers of air separation systems and other heat exchangers, reference is made to relevant technical literature—for example, H.-W. Häring (ed.), Industrial Gases Processing, Wiley-VCH, 2006—in particular, section 2.2.5.6, "Apparatus." Details on heat exchangers in general can be found, for example, in the publication, "The Standards of the Brazed Aluminium Plate-Fin Heat Exchanger Manufacturers' Association," 2nd edition, 2000—in particular, section 1.2.1, "Components of an Exchanger."

Without additional measures, heat exchangers of air separation systems and other heat exchangers through which warm and cryogenic media flow perform temperature equalization and heat up when the associated system is at a standstill and the heat exchanger is thus taken out of operation, or the temperature profile forming in a corresponding heat exchanger during steady-state operation cannot be maintained in such a case. If, for example, cryogenic gas is subsequently fed into a heated heat exchanger or, vice versa, when it is put back into operation, high thermal stresses occur as a result of different thermal expansion due to differential temperature differences, which, in the longer term, can lead to damage to the heat exchanger or require a disproportionately high material or manufacturing outlay in order to avoid such damage.

In particular, when a heat exchanger is taken out of operation before it has completely heated up, the temperatures at the previously warm end and at the previously cold end equalize due to the good thermal conduction (thermal longitudinal conduction) in its metallic material. In other words, the previously warm end of the heat exchanger becomes colder over time, and the previously cold end of the heat exchanger becomes warmer, until said temperatures are at or close to an average temperature. This is also illustrated again in the attached FIG. 1. The temperatures, which were here at approximately −175° C. or +20° C. at the time of being taken out of operation, become equal to each other over several hours, and almost reach a mean temperature.

This behavior is observed in particular when the main heat exchanger, which is accommodated in a cold-insulated manner, is blocked in together with the rectification unit, i.e., when no more gas is supplied from the outside, when an air separation system is switched off. In such a case, typically, only gas produced by thermal insulation losses is blown off cold. The same also applies if a system for liquefying a gaseous air product, e.g., liquid nitrogen, is switched off.

If warm fluid is, optionally, subsequently fed in at the cooled warm end of the heat exchanger when it is put back into operation, the temperature rises abruptly there. The temperature at the heated cold end correspondingly decreases abruptly if corresponding cold fluid is fed in there when the heat exchanger is put back into operation. This leads to the aforementioned material stresses and thus, possibly, to damage.

DE 10 2014 018 412 A1 discloses a method for operating a liquefaction process for liquefying a hydrocarbon-rich flow—in particular, natural gas. During start-up, and as long as the hydrocarbon-rich flow to be liquefied cannot be discharged in accordance with specifications, at least one refrigerant subflow at a suitable temperature level is conducted out of a refrigerant circuit, instead of the hydrocarbon-rich flow to be liquefied, through at least one heat exchanger in an amount which is controlled during start-up and which, upon reaching normal operation, is dimensioned such that it compensates for the amount of heat introduced into the refrigeration circuit during normal operation by the hydrocarbon-rich flow to be liquefied.

US 2015/226094 A1 or EP 2 880 267 A2 describes the generation of electrical energy in a combined system comprised of a power plant and an air treatment system. In a first operating mode, a storage fluid is produced in the air treatment system from input air and stored. In a second operating mode, the storage fluid is evaporated or pseudo-evaporated under superatmospheric pressure, and a gaseous, high-pressure fluid formed in the process is expanded in a gas expansion unit of the power plant. In the second operating mode, gaseous natural gas is liquefied or pseudo-liquefied against the evaporating or pseudo-evaporating storage fluid.

CN 102 778 105 A describes a quick start of an oxygen generator, in which, on the one hand, input air is expanded in a turboexpander before it is fed in liquefied form into the main rectification column, and in which, on the other, liquid argon stored in a storage container is used in a refrigeration circuit for cooling the input air.

US 2012/1617616 A1 or EP 2 449 324 B1 discloses a method for operating a liquefaction system for gas liquefaction using a main heat exchanger. A refrigerant compression circuit is provided, of which a low-pressure part conducts evaporated refrigerant from the main heat exchanger to a compressor, and a high-pressure part returns the compressed and cooled refrigerant from the compressor to the main heat exchanger. The pressure within the liquefaction system is controlled by regulating the amount of refrigerant evaporated in either the low-pressure or the high-pressure part of the liquefaction system, or in both parts of the system.

The aim of the present invention is to specify measures that allow a corresponding heat exchanger—in particular, in one of the aforementioned systems—to be put back into operation after being out of operation for a relatively long time, without the aforementioned disadvantageous effects occurring.

DISCLOSURE OF THE INVENTION

Against this background, the present invention proposes a method for operating a heat exchanger, an arrangement having a correspondingly operable heat exchanger, and a system having a corresponding arrangement having the features of the respective independent claims.

First, some terms used to describe the present invention are explained and defined below.

In the terminology used herein, a "heat exchanger" is an apparatus which is designed for indirectly transferring heat between at least two fluid flows—for example, ones guided in counter-flow relative to one another. A heat exchanger for use within the scope of the present invention can be formed from one or more heat exchanger sections connected in parallel and/or in series, e.g., from one or more plate heat exchanger blocks. A heat exchanger has "passages" which are configured to conduct fluid and are separated from other passages by separating plates or connected on the inlet and outlet sides only via the respective headers. The passages are separated from the outside by means of side bars. Said passages are referred to below as "heat exchanger passages." Following the customary terminology, the two terms, "heat exchanger" and "heat transfer device," are used synonymously below. The same also applies to the terms, "heat exchange" and "heat transfer."

The present invention relates in particular to the apparatuses referred to as plate-fin heat exchangers according to ISO 15547-2:2005. If a "heat exchanger" is referred to below, this is therefore to be understood as meaning, in particular, a plate-fin heat exchanger. A plate-fin heat exchanger has a plurality of flat chambers or elongate channels lying one above the other, which are separated from one another in each case by corrugated or otherwise structured and interconnected—for example, soldered—plates, generally made of aluminum. The plates are stabilized by means of side bars and connected to one another via said side bars. The structuring of the heat exchanger plates is used in particular to increase the heat exchange surface, but also to increase the stability of the heat exchanger. The invention relates in particular to soldered plate-fin heat exchangers made of aluminum. In principle, however, corresponding heat exchangers can also be produced from other materials, e.g., stainless steel, or from various different materials.

As mentioned, the present invention can be used in air separation systems of the known type, but also, for example, in systems for storing and recovering energy using liquid air. The storage and recovery of energy using liquid air is also referred to as Liquid Air Energy Storage (LAES). A corresponding system is disclosed, for example, in EP 3 032 203 A1. Systems for liquefying nitrogen or other gaseous air products are likewise known from the technical literature and are also described with reference to FIG. 3. In principle, the present invention can also be used in any further systems in which a heat exchanger can be correspondingly operated. For example, these can be systems for natural gas liquefaction and separation of natural gas, the aforementioned LAES systems, systems for air separation, liquefaction circuits of all types (in particular, for air and nitrogen), with and without air separation, ethylene systems (i.e., in particular, separating systems which are configured to process gas mixtures from steam crackers), systems in which cooling circuits, e.g., with ethane or ethylene, are used at different pressure levels, and systems in which carbon monoxide circuits and/or carbon dioxide circuits are provided.

In LAES systems, in a first operating mode at times of high power supply, air is compressed, cooled, liquefied, and stored in an insulated tank system, with a corresponding power consumption. In a second operating mode at times of low power supply, the liquefied air stored in the tank system is heated—in particular, after an increase in pressure by means of a pump—and is thus converted into the gaseous or supercritical state. A pressure flow obtained thereby is expanded in an expansion turbine, which is coupled to a generator. The electrical energy obtained in the generator is fed back into an electrical grid, for example.

In principle, corresponding storage and recovery of energy is possible not just with the use of liquid air. Rather, other cryogenic liquids formed using air can also be stored in the first operating mode and used to generate electrical energy in the second operating mode. Examples of corresponding cryogenic liquids are liquid nitrogen or liquid oxygen or component mixtures consisting predominantly of liquid nitrogen or liquid oxygen. External heat and fuel can also be coupled into corresponding systems in order to increase efficiency and output power—in particular, using a gas turbine, the exhaust gas of which is expanded together with the pressure flow formed in the second operating mode from the air product. The invention is also suitable for such systems.

Traditional air separation systems can be used to provide corresponding cryogenic liquids. If liquid air is used, it is also possible to use pure air liquefaction systems. The term, "air treatment systems," is therefore also used below as an umbrella term for air separation systems and air liquefaction systems.

The present invention can, in particular, also be used in so-called nitrogen liquefiers. Systems for liquefying and/or separating gases other than air also benefit from the measures proposed according to the invention.

ADVANTAGES OF THE INVENTION

In principle, while the associated system is at a standstill, cold gas from a tank or exhaust gas from the stopped system can flow through a heat exchanger in order to avoid heating or to maintain the temperature profile formed during steady-state operation (i.e., in particular, the usual production operation of a corresponding system). However, such an operation, in which the usual passages also used for normal operation are accordingly used, can, possibly, be realized only in a complex manner in conventional methods.

In specific cases, as also proposed, for example, in U.S. Pat. No. 5,233,839 A, in order to avoid cooling the warm end of a corresponding heat exchanger, heat can also be introduced there from the environment via heat bridges. If there is no process unit with significant buffer capacity for cold (e.g., no rectification column system with accumulation of cryogenic liquids) downstream of the heat exchanger, such as in a pure air liquefaction system, such temperature maintenance alone can thus reduce the occurrence of excessive thermal stresses when warm process flows are abruptly supplied at the warm end when the heat exchanger is put back into operation.

In this case, the warm process flows supplied after the heat exchanger is put back into operation can, for example, be at least partially expanded in an expansion machine after exiting at the cold end of the heat exchanger and be returned to the warm end via the cold end as cold flows (which, however, in this case do not yet have the low temperature that they present at the cold end in the later course of normal operation). In this way, the heat exchanger can be slowly brought to its normal temperature profile by Joule-Thomson cooling.

However, the present invention relates less to this case, i.e., less to processes in which, after restarting, the cold end of the heat exchanger is not directly supplied with cold process flows (at the final temperature present in normal operation), but rather to the case where cryogenic fluids are present from the beginning of the heat exchanger being put back into operation, which fluids are to be heated by the heat exchanger and which are therefore supplied to the heat exchanger at the cold end, starting from when the heat exchanger is put back into operation.

If there is a process unit having a considerable buffer capacity for cold (e.g., a rectification column system with accumulation of cryogenic liquids, as in an air separation system) downstream of the heat exchanger, as is the case within the scope of the present invention, it is possible, by means of the measures described above, to minimize the occurrence of thermal stresses at this location, but thermal stresses resulting from impermissibly high (temporal and local) temperature gradients can occur at the simultaneously-warmed cold end owing to the abrupt starting of through-flow with colder fluid. In this case, the maintenance of the temperature of the warm end even promotes the formation of higher temperature differences at the cold end, and thus promotes the occurrence of increased thermal stresses. In such cases, cooling or keeping cold the cold end of the heat exchanger is therefore desirable or advantageous.

As mentioned, the present invention relates in particular to the case just explained. In other words, the case is considered, within the scope of the present invention, that (in addition to the always possible heating at the warm end of the heat exchanger) the cold end of the heat exchanger is cooled or kept cold during standstill phases.

In order to cool or keep cold the cold end of a corresponding heat exchanger, as also proposed in U.S. Pat. No. 5,233,839 A, the respective region to be cooled can be equipped with additional cooling passages, which can, in particular, be applied on the outside of the heat exchanger (block). By means of an arrangement differing in density of corresponding passages (which can also be formed by a single, meandering line in the form of corresponding line sections), it is possible to meter the respectively dissipated heat (or, in a—physically-speaking—incorrect manner of expression, the introduced cold). Alternatively, it is also possible to use passages of the heat exchanger used during normal operation at least in part for cooling or keeping-cold the cold end.

Against this background, the present invention proposes a method for operating a heat exchanger. As also explained in detail below, the heat exchanger can in particular be part of a corresponding arrangement, which in turn can be designed as part of a larger system. The present invention can be used in particular in air treatment systems of the type described in detail above and below. In principle, however, use in other fields of application is also possible, in which a flow through a corresponding heat exchanger is prevented during certain times, and the heat exchanger heats up during these times, or a temperature profile formed in the heat exchanger equalizes. In particular, the present invention can be used in an air separation system, since a buffer capacity for cold fluid is present at the cold end of the heat exchanger in a corresponding air separation system, and the keeping-cold of the cold end during standstill phases is therefore desirable.

However, in this case, the present invention relates, in embodiments, also to such measures that avoid excessive thermal loading of the warm end of a heat exchanger. Within the scope of the present invention, such measures can be combined with the measures proposed according to the invention and aimed at reducing thermal stresses at the cold end of the heat exchanger.

In one embodiment (hereafter referred to as the "first" embodiment), the present invention is based upon the finding that cooling using an—in particular—cryogenic liquid, which is in evaporation passages on or in the heat exchanger but not already previously evaporated, offers particular advantages. By using the measures proposed according to the invention, complex pumps for providing a cooling flow can, in particular, be dispensed with. The operation of the heat exchanger proposed according to the invention therefore offers advantages, because both the consumption of cold fluids is thereby reduced, and corresponding hardware and control and regulation technology do not have to be provided in a complex manner. A further advantageous embodiment of the invention (hereinafter referred to as the "second" embodiment) is based upon the finding that particular advantages can also be offered if gas is used as cooling fluid but is not conducted through the entire heat exchanger, but only over a section at the cold end through its heat exchanger passages.

The first embodiment is first explained below.

According to the first embodiment, the cooling at the cold end of a corresponding heat exchanger is carried out with liquid, e.g., with liquid nitrogen, which is extracted from a container. The container can, in particular, be supplied with an appropriate liquid during regular operation. The liquid is extracted from the container in liquid form and supplied to evaporation passages in or on the heat exchanger. The evaporation passages can also be formed by line sections of a line provided on or in the heat exchanger in a suitable arrangement. Passages that are also used in regular operation of a corresponding heat exchanger for cooling and/or heating fluids can in principle also be used as corresponding evaporation passages.

Corresponding liquid is extracted from the container and fed into the evaporation passages, in particular, when a maximum temperature is exceeded at the cold end of the heat exchanger. The liquid in the container is, in particular, at or near its boiling point. The container can be fed from a further container or tank or another source (for example, the low-pressure column of an air separation system).

As a result of the beginning temperature compensation in the heat exchanger by thermal conduction, heat is removed from the refrigerant, and evaporation occurs. The arrangement in the first embodiment of the present invention is such that a gas formed during the evaporation of liquid (partially or completely) flows back into the tank (circulation principle). In particular, by means of a pressure regulator at a gas phase outlet of the container, a defined container pressure can be adjusted in order to adjust the desired evaporation temperature level of the refrigerant. This is, in particular, a limit temperature for the cold end of the heat exchanger to be kept cold.

In the first embodiment of the present invention, the arrangement is, overall, such that a driving pressure gradient, and thus a natural circulation, are established due to the evaporation of the liquid. The supply of the liquid to the container can likewise be regulated in that, for example, a metal temperature measurement at the heat exchanger determines the refrigerant flow into the container.

Aspects of the second embodiment of the invention have already been explained or are explained in more detail below.

In addition to the measures proposed according to the invention (i.e., both in the first and in the second embodiment), heat input at the warm end of the heat exchanger can take place, for example, by means of convective heat supply, heat supply by radiation, or electro-thermal resistance heating. Further details are explained below.

The cooling provided according to the invention at the cold end can, in particular, be adapted to a heating power introduced at the head end. By appropriately adjusting the supplied and dissipated amounts of heat, a defined temperature gradient is established as a result of the heat longitudinal conduction in the metallic heat exchanger, which temperature gradient is determined by conductive cross-sectional area, effective thermal conductivity, and other geometrical and process parameters. By adapted control of the cooling and, optionally, the heating, the approximately linear temperature gradient is adapted in such a way that the stationary temperature levels of the metallic heat exchanger at the warm and cold ends are maintained during the system standstill. The heating and cooling powers can be adapted to the equipment and process boundary conditions in all embodiments of the invention, e.g., on the basis of the measurement of flow and metal temperatures of the heat exchanger.

In contrast to a temperature control of the warm and cold ends of a corresponding heat exchanger using measures such as are disclosed in the aforementioned U.S. Pat. No. 5,233,839 A, the method proposed according to the invention in accordance with the first embodiment can have the advantage that, as a result of the liquid supply of the liquid used for cooling or keeping-cold, the amount of heat that can be dissipated is greater, and refrigerant can be conserved. According to the second embodiment, particularly targeted cooling can take place at the cold end of the heat exchanger.

Once again, in summary, the present invention proposes to carry out the method in a first operating mode in first time periods, and in a second operating mode in second time periods that alternate with the first time periods. The first time periods and the second time periods do not overlap each other within the scope of the present invention. Within the scope of the present invention, the first time periods or the first operating mode carried out in a first time period corresponds to the production operation of a corresponding system, i.e., in the case of an air separation system, which is the focus according to the invention, to the operating mode in which liquid and/or gaseous air products are provided by air separation. Accordingly, the second operating mode performed in the second operating time periods is an operating mode in which corresponding products are not formed. Corresponding second time periods or a second operating mode are used in particular for saving energy, e.g., in systems for liquefaction and re-evaporation of air products for energy generation or in the aforementioned LAES systems.

As already mentioned, in the second operating mode, flow preferably does not pass through the heat exchanger, or passes through it to a significantly lesser extent than in the first operating mode. However, the present invention does not fundamentally exclude certain amounts of gases from also being conducted through a corresponding heat exchanger in the second operating mode. The amount of fluids conducted through the heat exchanger in the second operating mode is always significantly below the amounts of fluids conducted through the heat exchanger in a regular, first operating mode. Within the scope of the present invention, the amount of the fluids conducted through the heat exchanger in the second operating mode is, for example, not more than 20%, 10%, 5%, or 1%, or 0.1% in total, relative to the amount of fluid conducted through the heat exchanger in the first operating mode.

Within the scope of the present invention, the first operating mode and the second operating mode are carried out alternately in the respective time periods, as mentioned, i.e., a respective first time period in which the first operating mode is carried out is always followed by a second time period in which the second operating mode is carried out, and the second time period or the second operating mode is then followed again by a first time period with the first operating mode, etc. However, this does not exclude, in particular, that further time periods with further operating modes can be provided between the respective first and second time periods—for example, a third time period with a third operating mode. Within the scope of the present invention, the following sequence in particular results in the case of a third operating mode: first operating mode—second operating mode—third operating mode—first operating mode, etc.

Within the scope of the present invention, in the first operating mode, a first fluid flow is formed at a first temperature level, is fed into the heat exchanger in a first region at the first temperature level, and is partially or completely cooled in the heat exchanger. Within the scope of the present invention, in particular a gas mixture to be separated by a gas mixture separation method, e.g., air which is separated in an air separation system, can be used as a corresponding first fluid flow.

Furthermore, in the first operating mode, a second fluid flow is formed at a second temperature level, is fed into the heat exchanger in a second region at the second temperature level, and is partially or completely heated in the heat exchanger. The formation of the second fluid flow can, in particular, represent a formation of a return flow in an air separation system in the form of an air product or a waste flow.

The second temperature level corresponds, in particular, to the temperature at which a corresponding return flow is formed in one. It is preferably at cryogenic temperatures—in particular, −50° C. to −200° C., e.g., −100° C. to −200° C. or −150° C. to −200° C. On the other hand, the first temperature level at which the first fluid flow is formed and supplied to the heat exchanger in the first region is preferably at the bypass temperature, but, in any case, typically at a temperature level significantly above 0° C.—for example, from 10° C. to 50° C.

If it is mentioned here that a first or second fluid flow is formed at the first or second temperature level, this of course does not exclude that further fluid flows are formed at the first or second temperature level. Corresponding further fluid flows may have a composition identical to or different from the fluid of the first or second fluid flow. For example, a total flow can initially be formed, from which the second fluid flow is formed by branching off the same. Furthermore, within the scope of the present invention, several fluid flows may, optionally, also be formed and subsequently combined with one another and used in this way to form the second fluid flow.

If it is mentioned here that a fluid flow in the heat exchanger is cooled or heated "partially or completely," it is to be understood that either the entire fluid flow is guided through the heat exchanger, either from a warm end or an intermediate temperature level to the cold end or an intermediate temperature level or vice versa, or that the corresponding fluid flow is divided in the heat exchanger into two or more subflows which are extracted from the heat exchanger at the same or different temperature levels. Of course, it is also possible to feed a further fluid flow to the respective fluid flow in the heat exchanger and to further cool or heat a combined flow formed in this way in the heat exchanger. In any case, however, a corresponding fluid flow is fed into the heat exchanger, at the first or second temperature level, and is cooled or heated in the heat exchanger (alone or together with further flows as explained above).

It is also self-evident that, in addition to the first and second fluid flows, further fluid flows can also be cooled or heated in the heat exchanger, to the same or different temperature levels and/or starting from the same or different temperature levels as the first or second fluid flow. Corresponding measures are customary and known in the field of air separation, and reference can therefore be made in this regard to relevant technical literature, as was cited at the outset.

Within the scope of the present invention, in the second operating mode, the feeding of the first fluid flow and of the second fluid flow into the heat exchanger and the respective cooling and heating in the heat exchanger is partially or completely halted. For example, it is possible for no fluid to be conducted through the heat exchanger instead of the first fluid flow, which is conducted through the heat exchanger and cooled in the heat exchanger in the first operating mode. The heat exchanger passages of the heat exchanger used in the first operating mode to cool the first fluid flow thus remain without flow in this case. However, instead of the first fluid flow, which is conducted through the heat exchanger and cooled in the first operating mode, it is also possible to conduct a different fluid flow through the heat exchanger—in particular, in a significantly smaller quantity. The same also applies to the second fluid flow, which can be replaced by other gas in the second operating mode, but without, in the context of the present invention, effecting cooling at the cold end of the heat exchanger, i.e., the mentioned second region.

If cooling of the cold end of the heat exchanger is mentioned here, it takes place, in particular, to the second temperature level, at which this cold end is present in the first operating mode.

According to the invention, it is now provided that, using cooling fluid that is conducted through passages in or on the heat exchanger in the second region, but not in the first region, which according to the invention comprises the terminal 30% of the heat exchanger at the warm end, the second region be cooled in the second time period. As mentioned, the first and second embodiments in particular, concerning which important aspects have been explained above, are advantageous here. In order to avoid misunderstandings, it is emphasized that the first region is arranged at the warm end and the second region is arranged at the cold end of the heat exchanger, or the first region extends from the warm end in the direction of the cold end of the heat exchanger, and the second region extends from the cold end in the direction of the warm end of the heat exchanger.

In the first embodiment, the passages through which flow occurs in the second region of the heat exchanger (but not in the first region) are evaporation passages. They may be passages applied separately to the heat exchanger, but also sections of passages used for regular heat exchange. These passages or sections can, in particular, run on or in a region of the heat exchanger that extends from the second, cold end at most 50%, 40%, 30%, or 20% in the direction of the first, warm end. However, as mentioned, they are not arranged on or in the first region, which comprises the terminal 30% of the heat exchanger at the warm end. In the first embodiment, the second region is cooled by evaporation of a liquid, which is used as the cooling fluid, in evaporation passages that are in heat contact with the second region. The liquid used here—in particular, liquid nitrogen, as mentioned—is extracted from a container, gas formed during evaporation is (partially or completely) returned to the container, and the liquid is pushed through the evaporation passages by a pressure, built up by the evaporation, of the gas in the container. In this way, a natural circulation is established, and the amount of refrigerant used is reduced.

In contrast to methods according to the prior art, the evaporation temperature and the temperature of the cooling can be adjusted in the first embodiment, in particular, by adjusting the pressure in the entire system—in particular, using pressure regulation and corresponding blowing-off of gas from the container. By causing a liquid medium to evaporate for cooling, within the scope of the first embodiment of the present invention, the amount of heat dissipated can be significantly increased, with reduced refrigerant requirement in comparison to known methods in which a gas is used.

In the method according to the invention in accordance with the first embodiment, an amount to which the liquid is evaporated in the evaporation passages is, advantageously, adjusted by feeding the liquid into the container, wherein the feeding of the liquid into the container can, in particular, be regulated by means of temperature control. In this way, the temperature to which the second end of the heat exchanger is cooled can also be adjusted accordingly.

In the second embodiment of the invention, a gaseous cooling fluid is used. The passages used for cooling are in each case sections of heat exchanger passages which run in the heat exchanger between the first end and the second end and which are used in particular in the first operating mode for normal heat exchange—in particular, for the first and/or second fluid flow or further fluid flows. In this case, a section can be formed, in particular, by corresponding (intermediate) extraction options—for example, side headers. The passages in which corresponding sections are formed can, in particular, also comprise only a part, e.g., less than 50%, of the number of passages present in total.

In the second embodiment, the sections comprise a length of not more than 50%, 40%, 30%, or 20%, e.g., 5 to 15%, of a total length of the heat exchanger passages—in particular, between the first (warm) end and the second (cold) end. However, as mentioned, they are not arranged on or in the first region, which, according to the invention, comprises the terminal 30% of the heat exchanger at the warm end. By forming the sections in this way, in particular the second region or the cold end of the heat exchanger can be cooled in a targeted manner without causing (undesired) heat dissipation in the first region or in the warm end.

As already mentioned, in both embodiments, heat can be supplied in the present invention to the first region in the second time period in that this heat is provided by means of a heat source and transferred from outside the heat exchanger to the first region. In the simplest case, a corresponding heat source can be ambient heat, which can be introduced, for example, into a corresponding region of a cold box or conducted to the first region of the heat exchanger by means of suitable measures. However, the heat source may also be an active heating device, as also explained in more detail below.

For example, this heat may be provided by means of the heat source and transferred to the first region via a gas chamber located outside the heat exchanger, or this heat may be supplied to the heat exchanger block via a component contacting the heat exchanger, e.g., via metallic or non-metallic carriers, suspensions, or fasteners. Within the scope of the present invention, electrical heating bands with solid contact may also be used. In the embodiment in which the heat is transferred via the gas chamber, heat transfer takes place predominantly or exclusively without solid contact, i.e., predominantly or exclusively in the form of a heat transfer in the gas chamber, i.e., without or predominantly without heat transfer by solid-state thermal conduction. The term, "predominantly," refers here to a proportion of the amount of heat of less than 20% or less than 10%. If other heating devices, such as electrical heating bands, are used, these conditions, naturally, differ accordingly.

In this embodiment, the present invention thus provides for the warm end of a corresponding heat exchanger to be actively heated in the second time period or for passive heating to be carried out via a thermal conduction. The term, "outside the heat exchanger," delimits the present invention from an, alternatively, also possible heating by means of a targeted fluid flow through the heat exchanger passages. In this embodiment, heating thus, in particular, does not take place by transferring heat from a fluid conducted through the heat exchanger passages.

In this connection, it should be pointed out in particular that, when a "region" of a heat exchanger (the first region or the second region) is referred to here, such regions do not have to be limited to the direct feed point of the first or second fluid flow into the heat exchanger, but rather that these regions can also, in particular, be terminal sections of a corresponding heat exchanger, which can extend for a predetermined distance in the direction of the center of the heat exchanger. Corresponding regions can comprise, in particular, the terminal 10%, 20%, or 30% of a corresponding heat exchanger, wherein, according to the invention, the first region is understood to mean the terminal 30% at the warm end. Typically, corresponding regions are not structurally delineated in a defined manner from the rest of the heat exchanger.

In the context of the present invention, the heat can be transferred from outside the heat exchanger passages to the heat exchanger by means of the heat source through solid-state thermal conduction via a heat-conducting element contacting the first region. As already mentioned, this can, for example, take place via carriers or metallic or non-metallic elements as heat-conducting elements, which contact the heat exchanger and which in turn are heated, for example, by means of resistive or inductive heating. A corresponding arrangement can in principle be designed as proposed in U.S. Pat. No. 5,233,839 A.

As an alternative to the heat transfer through solid-state thermal conduction, however, the heat provided by means of the heat source can also be transferred to the first region via a gas chamber located outside the heat exchanger, as explained, and indeed at least partially by convection and/or at least partially by radiation, i.e., by heat radiation.

In the embodiment in which heat is transferred from the heating device to the first region via the gas chamber located outside the heat exchanger, the present invention the particular advantage that—for example, in contrast to the mentioned U.S. Pat. No. 5,233,839 A—no suspension of a corresponding region is required which is provided there for transferring the heat. The present invention thus allows, in this embodiment, temperature control even in cases in which a heat exchanger block is mounted in other regions, e.g., at the bottom or in the center, in order to, in this way, reduce the stresses on the lines connecting a corresponding heat exchanger to the environment. On the other hand, the method presented in the prior art can only be used if a corresponding heat exchanger block is suspended at the top. A further disadvantage of the method described in the aforementioned prior art in comparison to the mentioned embodiment of the invention is that heat is introduced there only to a limited extent at the bearings, and not over the entire surface of a heat exchanger in a corresponding region. This can result, for example, in icing at the sheet-metal jacket transitions of a corresponding heat exchanger. In contrast, in the embodiment mentioned, the present invention enables an advantageous introduction of heat, and, in this way, effective temperature control, without the disadvantages described above.

In particular, it can be provided within the scope of the present invention, as mentioned, to transfer the heat to the first region via the gas chamber at least partially by convection and/or radiation. For convective heat transfer, gas turbulence in particular can be induced, so that heat buildup can be avoided. On the other hand, heating solely by radiation may act directly on the the first region of the first heat exchanger via the corresponding infrared radiation.

The method according to the present invention is suitable, as mentioned multiple times, in particular for use in the context of a gas separation method, e.g., in the context of a method for the low-temperature separation of air or natural gas, in which a correspondingly liquefied gas mixture is supplied to a separation process. In the first operating mode, the first fluid flow is therefore, advantageously, supplied at least in part to a rectification process after the partial or complete cooling in the heat exchanger. In other words, it is provided in the gas separation method to at least partially liquefy the first fluid flow and to separate it, in particular, into fractions of different material compositions. However, certain changes, albeit minor in comparison with separation, may also already result from the liquefaction itself due to the different condensation temperatures.

The present invention extends to an arrangement with a heat exchanger, wherein the arrangement has means which are configured to carry out a first operating mode in first time periods and to carry out a second operating mode in second time periods that alternate with the first time periods, to form, in the first operating mode, a first fluid flow at a first temperature level, to feed it into the heat exchanger in a first region at the first temperature level, and to partially or completely cool it in the heat exchanger, to form, furthermore, in the first operating mode, a second fluid flow at a second temperature level, to feed it into the heat exchanger in a second region at the second temperature level, and to partially or completely heat it in the heat exchanger, and, in the second operating mode, to partially or completely halt the feeding of the first fluid flow and of the second fluid flow into the heat exchanger.

According to the invention, passages are provided in or on the heat exchanger in the second region, but not in the first region, which comprises the terminal 30% at the warm end of the heat exchanger according to the invention, and means are further provided that are configured to cool the second region in the second time period using cooling fluid that can be conducted through the passages in or on the heat exchanger in the second region, but not in the first region.

In the aforementioned first embodiment, which also relates to the arrangement according to the invention, the passages are used as evaporation passages through which flow occurs in the second region of the heat exchanger (but not in the first region), and a container is provided that is configured to receive a cryogenic liquid as the cooling fluid. Means are provided that are configured to extract the liquid from the container and to evaporate it in the evaporation passages, wherein these means are configured to return gas formed during evaporation to the container and to push the liquid through the evaporation passages by a pressure, built up by the evaporation, of the gas in the container.

In a corresponding arrangement, as already mentioned, the evaporation passages are provided on an outside of the heat exchanger—in particular, separately from passages formed inside the heat exchanger.

In the second embodiment, the passages are in each case sections of heat exchanger passages which run in the heat exchanger—in particular, between the first (warm) end and the second (cold) end—wherein the sections have a length of not more than 50% or 40%—in particular, not more than 30% or 20%, and in particular more than 5% or 10%—of a total length of the heat exchanger passages—in particular, between the first (warm) end and the second (cold) end—and wherein the cooling fluid can be provided in gaseous form and can be conducted through the sections of the heat exchanger passages. However, as mentioned, said sections are not formed in the first region comprising the terminal 30% of the heat exchanger at the warm end.

According to an advantageous embodiment, a heat source—in particular, a heating device—is furthermore provided that is configured to supply heat to the first region in the second time period by providing the heat by means of the heat source and transferring it from outside the heat exchanger to the first region.

For further aspects of an arrangement according to the invention and its advantageous embodiments, reference is expressly made to the above explanations regarding the method according to the invention and its embodiments. The arrangement according to the invention benefits from the advantages described for corresponding methods and method variants.

Within the scope of the present invention, the heat exchanger is, advantageously, arranged in a cold box, wherein a gas chamber, through which the heat can be transferred, is formed by a region, free of insulating material, within the cold box. The first region of the heat exchanger can in this case be arranged within the cold box in the gas chamber—in particular, without suspensions contacting the first region. For the advantage in this respect, reference is also made to the above explanations.

Within the scope of the present invention, the heat source can, in particular, be designed as a heating device in the form of a radiant heater, which can be heated, for example, electrically or using heating gas. However, the heating device may also be designed in particular as a resistive or convective heating device, which heats a heat-conducting element contacting the first region of the heat exchanger.

The present invention furthermore extends to a system which is characterized in that here has an arrangement as explained above. The system can in particular be designed as a gas mixture separation system. It is furthermore characterized in particular in that it is configured to carry out a method as previously explained in embodiments.

The invention is described in more detail hereafter with reference to the accompanying drawings, which show an embodiment of the invention and corresponding heat exchange diagrams.

In the figures, elements which are identical or correspond to one another in function or meaning are indicated by identical reference signs and, for the sake of clarity, are not explained repeatedly.

DETAILED DESCRIPTION OF THE DRAWINGS

Figure 1:
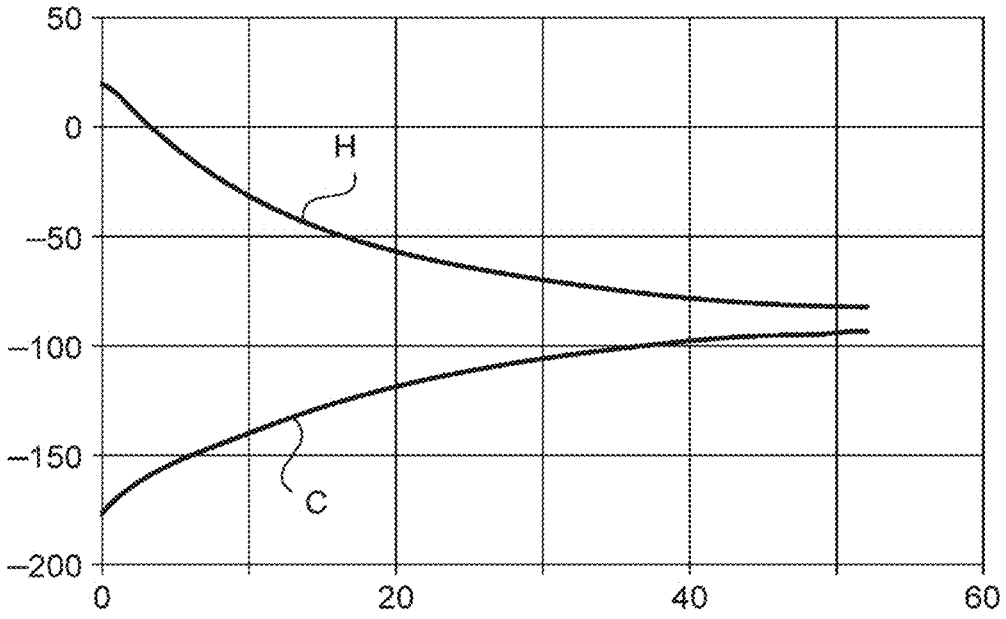
FIG. 1 illustrates temperature profiles in a heat exchanger after it has been taken out of operation, without the use of measures according to an embodiment of the present invention.

FIG. 1 illustrates temperature profiles in a heat exchanger after it has been taken out of operation (through which heat exchanger no flow occurs), without the use of measures according to advantageous embodiments of the present invention, in the form of a temperature diagram.

In the diagram shown in FIG. 1, a temperature at the warm end of a corresponding heat exchanger, denoted by H, and a temperature at the cold end, denoted by C, are each shown in ° C. on the ordinate over a time in hours on the abscissa.

As can be seen from FIG. 1, at the beginning of the shutdown, the temperature H at the warm end of the heat exchanger, which still corresponds to the temperature in a regular operation of the heat exchanger, is approximately 20° C., and the temperature C at the cold end is approximately −175° C. These temperatures become more equal to each other over time. The high thermal conductivity of the materials installed in the heat exchanger is responsible for this. In other words, heat flows from the warm end towards the cold end here. Together with the heat input from the environment, a mean temperature of approx. −90° C. results. The significant temperature increase at the cold end occurs largely due to the internal temperature equalization in the heat exchanger, and only to a smaller extent due to external heat input.

As mentioned several times, in the case shown, severe thermal stresses may occur if the warm end of the heat exchanger, after some time of regeneration, is, without further measures, again subjected to a warm fluid of—in the example shown—approximately 20° C. However, thermal stresses may also, correspondingly, occur if a system downstream of the heat exchanger immediately delivers cryogenic fluids again—for example, cryogenic fluids from a rectification column system of an air separation system. However, the present invention relates less or not at all to systems in which the latter problem occurs.

Figure 2:
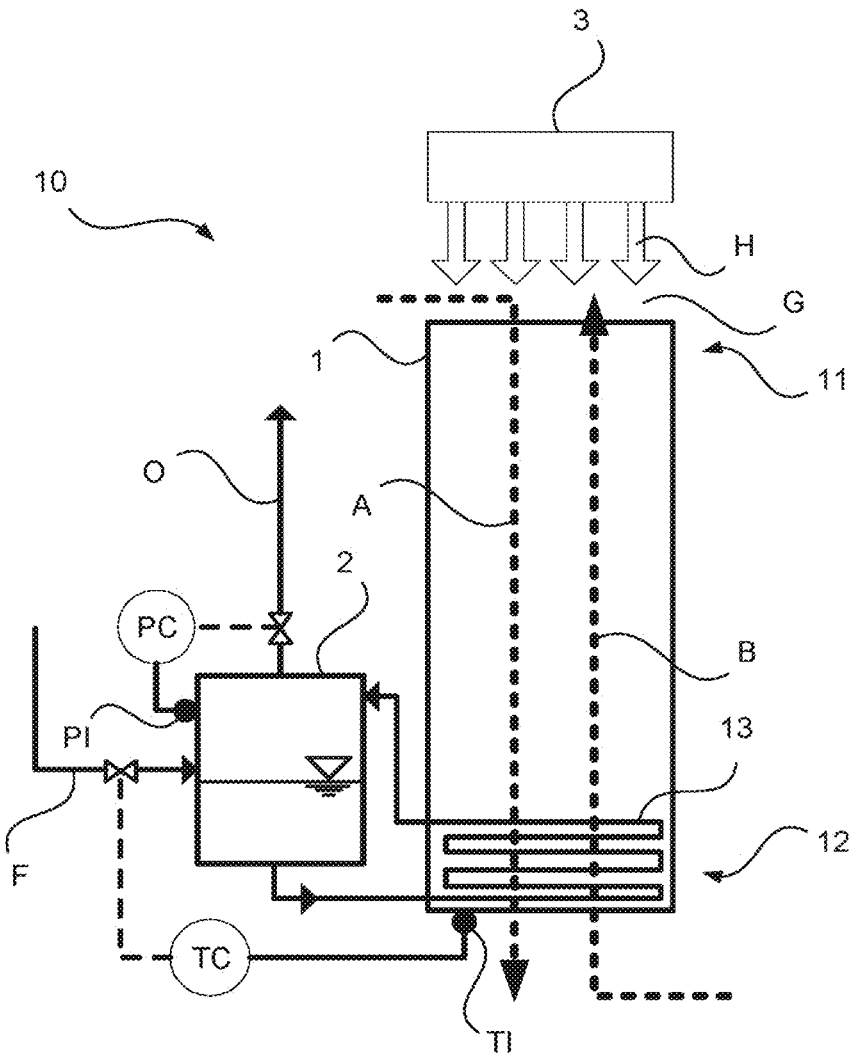
FIG. 2 illustrates an arrangement with a heat exchanger according to a particularly preferred embodiment of the invention.

In FIG. 2, an arrangement with a heat exchanger according to a particularly preferred embodiment of the present invention is illustrated and designated as a whole by 10. The embodiment according to FIG. 2 substantially corresponds to the first embodiment explained above.

The heat exchanger is provided with reference sign 1. It has a first region 11 and a second region 12, which are here not structurally distinguished from the rest of the heat exchanger 1. The first region 11 and the second region 12 are characterized in particular by the feeding or extraction of fluid flows.

In the example shown, two fluid flows A and B are conducted through the heat exchanger 1, wherein fluid flow A is previously referred to as the first fluid flow, and fluid flow B is previously referred to as a second fluid flow. The first fluid flow A is cooled in the heat exchanger 1, whereas the second fluid flow B is heated. The fluid flows A and B through the heat exchanger are typically conducted only during normal operation, i.e., the first time period or operating mode explained above. In contrast, the cooling explained below takes place in a second time period or operating mode.

For further details, reference is made to the explanations above. It should be emphasized in particular that, in the second operating mode explained several times, the corresponding fluid flows A and B do not flow through the heat exchanger, or do not flow through it to the same extent as in the first operating mode. For example, in the second operating mode, fluid flows other than fluid flows A and B can be used, or fluid flows A and B can be used in smaller quantities.

The heat exchanger 1 can be accommodated in the arrangement 10 in a cold box (not shown), which can, in particular, be partially filled with an insulating material—for example, perlite. A region which is free of the insulating material and simultaneously constitutes a gas chamber surrounding the first region 11 of the heat exchanger 1, is indicated by G.

In the arrangement 10, a heating device 3 is provided, which heats the first region 11 of the heat exchanger 1 during certain time periods of the second operating mode or during the entire second operating mode. For this purpose, heat H, illustrated here in the form of several arrows, can be transferred by means of the heating device 3 in the arrangement 10 to the first end 11 or the first region 11 of the heat exchanger 1. Although the transfer of heat is illustrated here via the gas chamber G, it can in principle also take place via a—for example, metallic—heat-conducting element if the heating device 3 is designed accordingly. In the first operating mode, no corresponding heat transfer typically takes place. According to the embodiment of the invention illustrated here, the second region 12 of the heat exchanger is cooled, or heat is actively dissipated therefrom, as explained below.

In the embodiment of the present invention illustrated here, the second region 12 of the heat exchanger 1 is cooled by evaporation of a liquid in evaporation passages 13, which are in heat contact with the second region 12. The liquid is extracted from a container 2, and gas formed during evaporation is partially or completely returned to the container 2. In the embodiment of the invention illustrated here, the liquid is pushed through the evaporation passages 13 by a pressure, built up by the evaporation, of the gas in the container 2. A natural circulation is thus established.

In the arrangement according to FIG. 2, an amount to which the liquid is evaporated in the evaporation passages 13 is adjusted by feeding the liquid into the container 2 via a feed line F. The feeding of the liquid into the container 2 is regulated by means of a temperature control TC on the basis of a value detected by means of a temperature transducer TI.

In the embodiment illustrated here, the pressure, built up by the evaporation of the gas, in the container 2 is, furthermore, adjusted by blowing off gas from the container 2, for which purpose a pressure regulation PC with a pressure transducer is used here. This acts on a valve, not separately designated, in an off-gas line O. An appropriate pressure setting furthermore adjusts the evaporation temperature and thus the cooling temperature.

Figure 3:
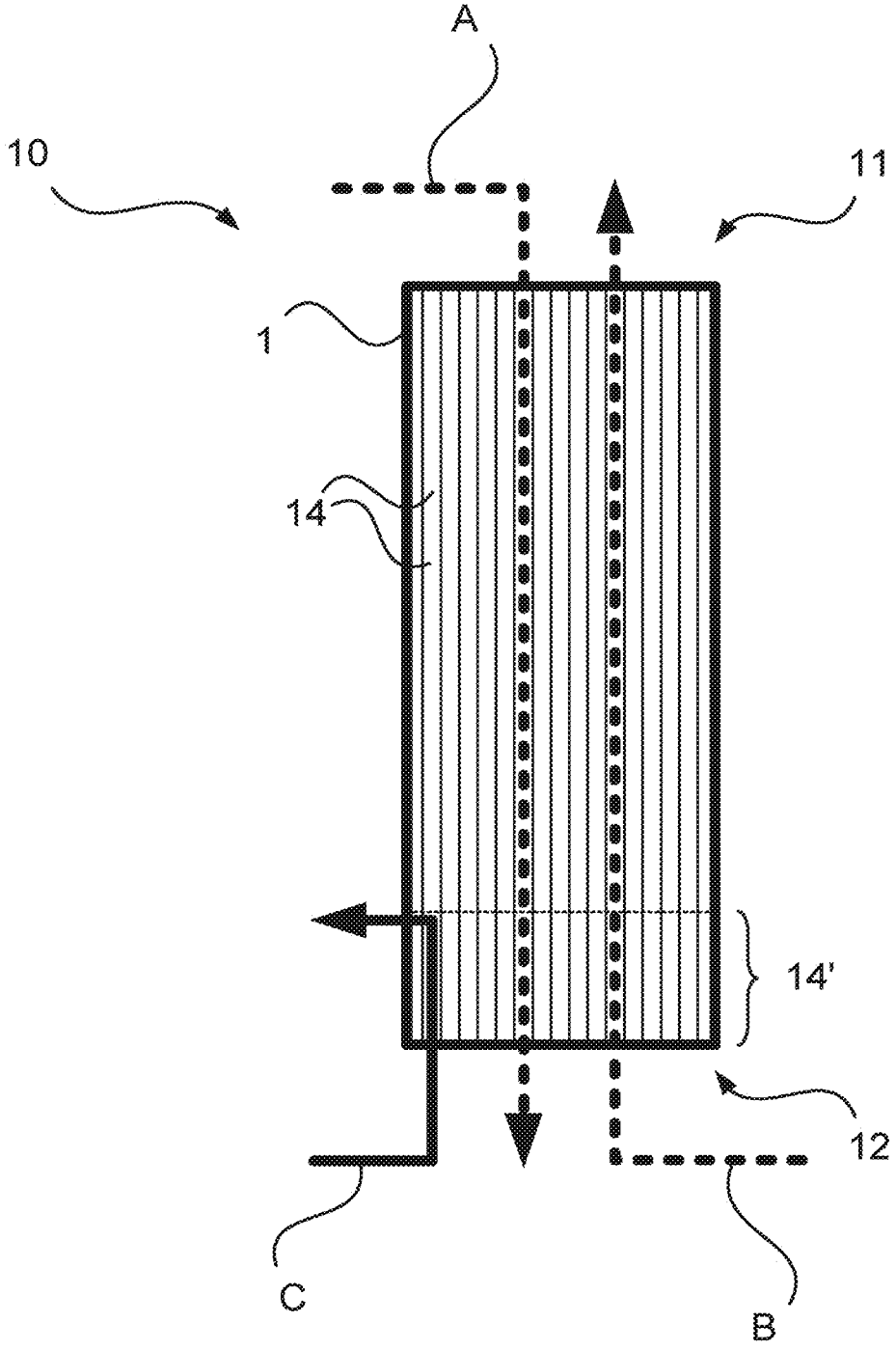
FIG. 3 illustrates an arrangement with a heat exchanger according to a further, particularly preferred, embodiment of the invention.

FIG. 3 illustrates an arrangement with a heat exchanger according to a particularly preferred embodiment of the present invention. The embodiment according to FIG. 3 substantially corresponds to the second embodiment explained above.

Here as well, the arrangement is designated as a whole by 10. The heat exchanger is again provided with reference sign 1. It has a first region 11 and a second region 12. For further details, reference is made to the explanations relating to FIG. 2.

In the example shown, two fluid flows A and B are also conducted here through the heat exchanger 1, wherein fluid flow A was previously referred to as first fluid flow, and fluid flow B was previously referred to as second fluid flow. The first fluid flow A is cooled in the heat exchanger 1, whereas the second fluid flow B is heated. The fluid flows A and B through the heat exchanger are typically conducted only during normal operation, i.e., the first time period or operating mode explained above. In contrast, the cooling explained below takes place in a second time period or operating mode.

Heat exchanger passages 14, only indicated here, each run in the heat exchanger 1 between the first end 11 and the second end 12.

The passages each have sections 14', which comprise a length of not more than 20% of a total length of the heat exchanger passages 14 between the first end 11 and the second end 12. A cooling fluid C is provided in gaseous form and conducted through the sections 14' of the heat exchanger passages 14.

Figure 4:
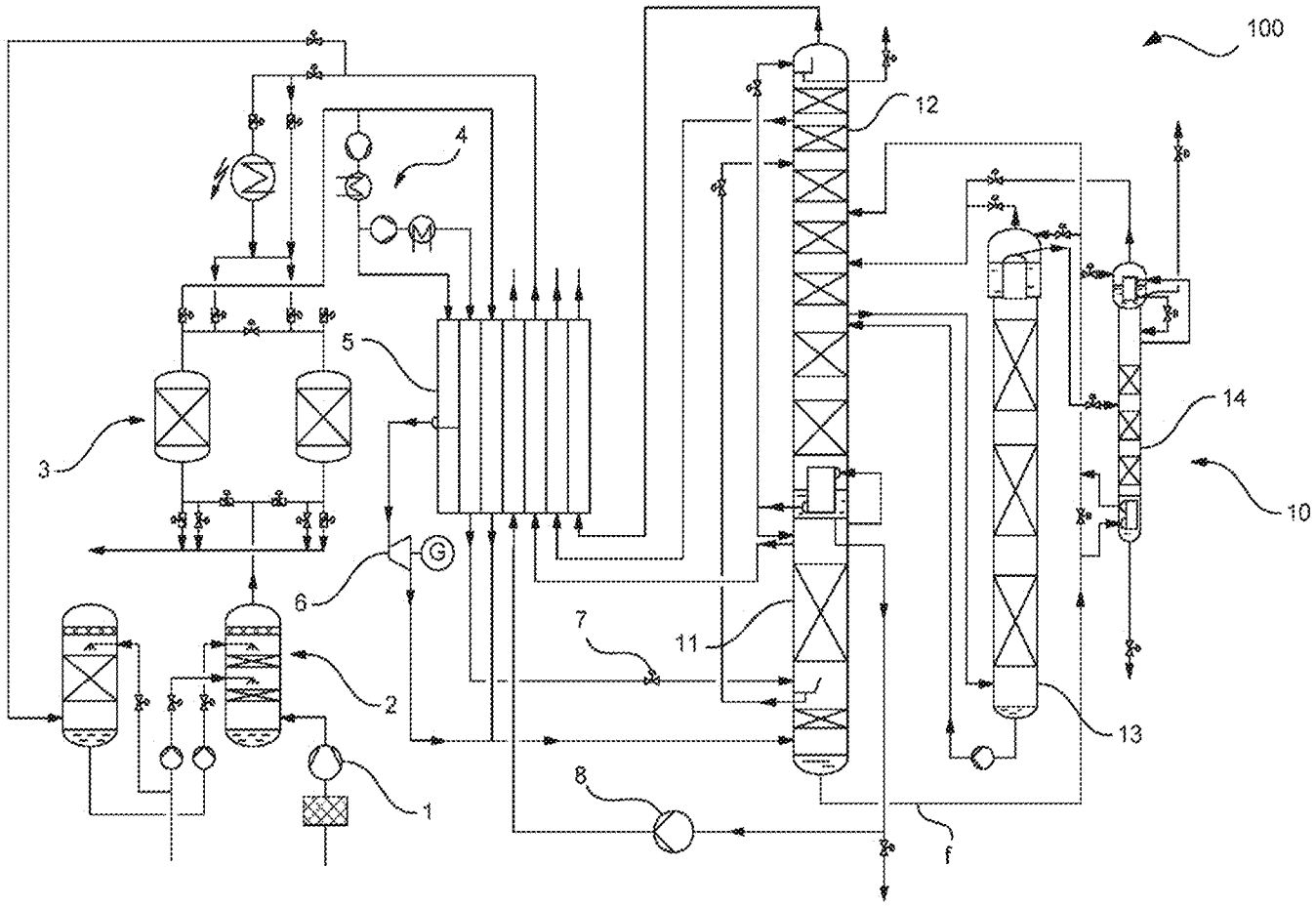
FIG. 4 illustrates an air separation system which can be equipped with an arrangement according to an embodiment of the invention.

FIG. 4 illustrates an air separation system having an arrangement with a heat exchanger, which arrangement can be operated using a method according to an advantageous embodiment of the present invention.

As mentioned, air separation systems of the type shown are described many times elsewhere—for example, in H.-W. Häring (ed.), Industrial Gases Processing, Wiley-VCH, 2006—in particular, section 2.2.5, "Cryogenic Rectification." For detailed explanations regarding structure and operating principle, reference is therefore made to corresponding technical literature. An air separation system for use of the present invention can be designed in a wide variety of ways. The use of the present invention is not limited to the embodiment according to FIG. 4.

The air separation system shown in FIG. 4 is designated as a whole by 100. It has, inter alia, a main air compressor 101, a pre-cooling device 102, a cleaning system 103, a secondary compressor arrangement 104, a main heat exchanger 105, which can be the heat exchanger 1 as explained above and is in particular part of a corresponding arrangement 10, an expansion turbine 106, a throttle device 107, a pump 108, and a distillation column system 110. In the example shown, the distillation column system 110 comprises a traditional double-column arrangement consisting of a high-pressure column 111 and a low-pressure column 112, as well as a crude argon column 113 and a pure argon column 114.

In the air separation system 100, an input air flow is sucked in and compressed by means of the main air compressor 101 via a filter (not labeled). The compressed input air flow is supplied to the pre-cooling device 102 operated with cooling water. The pre-cooled input air flow is cleaned in the cleaning system 103. In the cleaning system 103, which typically comprises a pair of adsorber containers used in alternating operation, the pre-cooled input air flow is largely freed of water and carbon dioxide.

Downstream of the cleaning system 103, the input air flow is divided into two subflows. One of the subflows is completely cooled in the main heat exchanger 105 at the pressure level of the input air flow. The other subflow is recompressed in the secondary compressor arrangement 104 and likewise cooled in the main heat exchanger 105, but only to an intermediate temperature. After cooling to the intermediate temperature, this so-called turbine flow is expanded by means of the expansion turbine 106 to the pressure level of the completely-cooled subflow, combined with it, and fed into the high-pressure column 111.

An oxygen-enriched, liquid bottom fraction and a nitrogen-enriched, gaseous top fraction are formed in the high-pressure column 111. The oxygen-enriched, liquid bottom fraction is withdrawn from the high-pressure column 111, partially used as heating medium in a bottom evaporator of the pure argon column 114, and fed, in each case, in defined proportions into a top condenser of the pure argon column 114, a top condenser of the crude argon column 113, and the low-pressure column 112. Fluid evaporating in the evaporation chambers of the top condensers of the crude argon column 113 and the pure argon column 114 is also transferred into the low-pressure column 112.

The gaseous, nitrogen-rich top product g is withdrawn from the top of the high-pressure column 111, liquefied in a main condenser which produces a heat-exchanging connection between the high-pressure column 111 and the low-pressure column 112, and, in proportions, is applied as a reflux to the high-pressure column 111 and expanded into the low-pressure column 112.

An oxygen-rich, liquid bottom fraction and a nitrogen-rich, gaseous top fraction are formed in the low-pressure column 112. The former is partially brought to pressure in liquid form in the pump 108, heated in the main heat exchanger 105, and provided as a product. A liquid, nitrogen-rich flow is withdrawn from a liquid-retaining device at the top of the low-pressure column 112 and discharged from the air separation system 100 as a liquid nitrogen product. A gaseous, nitrogen-rich flow withdrawn from the top of the low-pressure column 112 is conducted through the main heat exchanger 105 and provided as a nitrogen product at the pressure of the low-pressure column 112. Furthermore, a flow is withdrawn from an upper region of the low-pressure column 112 and, after heating in the main heat exchanger 105, is used as so-called impure nitrogen in the pre-cooling device 102 or, after heating by means of an electric heater, is used in the cleaning system 103.

The invention claimed is:

1. The method for operating a heat exchanger having a warm end and a cold end, said method comprising:

performing a first operating mode in first time periods, and performing a second operating mode in second time periods, wherein said second time periods alternate with the first time periods, wherein in the first operating mode, a first fluid flow at a first temperature level is fed into a first region of said heat exchanger at the first temperature level, and is partially or completely cooled in the heat exchanger, wherein in the first operating mode, a second fluid flow at a second temperature level, is fed into a second region of said heat exchanger at the second temperature level, and is partially or completely heated in the heat exchanger, wherein in the second operating mode, the feeding of the first fluid flow and of the second fluid flow into the heat exchanger is partially or completely halted, and wherein in the second time period, the second region is cooled using cooling fluid conducted through passages in or on the heat exchanger in the second region, but not in the first region, wherein said first region comprises the terminal 30% at the warm end of the heat exchanger.

2. The method according to claim 1, wherein the passages of the second region of the heat exchanger through which the cooling fluid is conducted in the second time period are evaporation passages through which flow occurs, the cooling fluid conducted through the second region during the second time period is a liquid that is extracted from a container and evaporated in the evaporation passages, gas, formed during evaporation of the cooling liquid during the second time period, is returned to the container, and during the second time period, the cooling liquid is pushed through the evaporation passages by a pressure, built up by evaporation of the cooling liquid, of gas in the container.

3. The method according to claim 2, wherein the evaporation of the cooling liquid in the evaporation passages is adjusted by feeding liquid into the container.

4. The method according to claim 2, wherein the pressure, built up by the evaporation of the cooling liquid, in the container is adjusted by blowing off gas from the container.

5. The method according to claim 1, wherein the passages of the second region of the heat exchanger through which the cooling fluid is conducted in the second time period are in each case sections of heat exchanger passages running in the heat exchanger, the sections comprise a length of not more than 50% of a total length of the heat exchanger passages, and the cooling fluid is provided to the sections in gaseous form and conducted through the sections of the heat exchanger passages.

6. The method according to claim 1, wherein heat is transferred to the first region in the second time period.

7. The method according to claim 6, wherein transfer of heat to the first region is provided by means of a heat source arranged outside the heat exchanger, and the heat is transferred from outside the heat exchanger to the first region.

8. The method according to claim 7, wherein the transfer of heat is performed by solid-state thermal conduction via a heat-conducting element contacting the first region.

9. The method according to claim 7, wherein the transfer of heat to the first region is performed via a gas chamber located outside the heat exchanger, wherein the heat is to the first region via the gas chamber at least partially by convection and/or radiation.

10. The method according to claim 1, wherein the heat exchanger is operated within a gas separation method and in which, in the first operating mode, the first fluid flow is supplied at least partially to a rectification process after partial or complete cooling in the heat exchanger.

11. The method according to claim 2, wherein, as the evaporation passages, the method uses at least part of the passages of the heat exchanger conducting the first fluid flow and/or the second fluid flow in the first operating mode.

12. The method according to claim 1, wherein the passages of the second region of the heat exchanger through which the cooling fluid is conducted in the second time period are in each case sections of heat exchanger passages running in the heat exchanger, the sections comprise a length of not more than 40% of a total length of the heat exchanger passages, and the cooling fluid is provided to the sections in gaseous form and conducted through the sections of the heat exchanger passages.

13. The method according to claim 2, wherein, as the evaporation passages, the method uses passages formed on an outside of the heat exchanger separately from passages formed within the heat exchanger.

14. An arrangement having a heat exchanger which heat exchanger has a warm end and a cold end, wherein the arrangement comprises:

means to carry out a first operating mode in first time periods and to carry out a second operating mode in second time periods, wherein the second periods alternate with the first time periods, in the first operating mode, means to feed a first fluid flow into the heat exchanger in a first region at a first temperature level, and means to cool the first fluid flow partially or completely in the heat exchanger, in the first operating mode, means to feed a second fluid into the heat exchanger in a second region at a second temperature level, and means to heat the second fluid flow partially or completely in the heat exchanger, and in the second operating mode, means to partially or completely halt the feeding of the first fluid flow and of the second fluid flow into the heat exchanger, wherein passages are provided in or on the heat exchanger in the second region, but not in the first region, which comprises the terminal 30% at the warm end of the heat exchanger, and means configured to cool the second region in the second time period using cooling fluid conducted through the passages in or on the heat exchanger in the second region, but not in the first region.

15. The arrangement according to claim 14, wherein the passages are provided as evaporation passages through which flow occurs in the second region of the heat exchanger, wherein a container is provided that is configured to receive a cryogenic liquid as the cooling fluid, wherein means are provided to extract the cryogenic liquid from the container and to evaporate the cryogenic liquid in the evaporation passages, and wherein means to return gas, formed during evaporation of the cryogenic liquid in the evaporation passages, to the container and to push the liquid through the evaporation passages by a pressure, built up by the evaporation, of the gas in the container.

16. The arrangement according to claim 14, wherein the passages are in each case sections of heat exchanger passages running in the heat exchanger, the sections comprise a length of not more than 50% of a total length of the heat exchanger passages, and the cooling fluid can be provided to the sections in gaseous form and can be conducted through the sections of the heat exchanger passages.

17. A system, including the arrangement according to claim 14, wherein the system is designed as a gas separation system.

18. The arrangement according to claim 16, wherein the sections comprise a length of not more than 40% of a total length of the heat exchanger passages.

19. The arrangement according to claim 16, wherein the sections comprise a length of not more than 30% of a total length of the heat exchanger passages.

20. The arrangement according to claim 16, wherein the sections comprise a length of not more than 20% of a total length of the heat exchanger passages.

21. A system, including the arrangement according to claim 14, wherein the system is designed as an air separation system.

* * * * *